United States Patent [19]

Theodore et al.

[11] 4,248,669

[45] Feb. 3, 1981

[54] PROCESS FOR MAKING METALLURGICAL COKE USING FLUIDIZER CHAR

[75] Inventors: Frank W. Theodore, Pittsburgh; George E. Wasson, Eighty-Four; William A. Jasulaitis, Bridgeville, all of Pa.; Everett Gorin, San Rafael, Calif.

[73] Assignee: Continental Oil Company, Stamford, Conn.

[21] Appl. No.: 934,750

[22] Filed: Aug. 21, 1978

Related U.S. Application Data

[63] Continuation-in-part of Ser. No. 764,629, Feb. 1, 1977, abandoned.

[51] Int. Cl.[3] ..... C10B 45/02; C10B 53/08; C10B 55/02; C10B 57/04

[52] U.S. Cl. ..... 201/6; 44/1 F; 44/15 A; 44/23; 201/22; 201/23; 208/8 LE

[58] Field of Search ..... 201/6, 22, 23; 44/1 A, 44/1 F, 15 A, 23; 208/8 LE

[56] References Cited

U.S. PATENT DOCUMENTS

| | | | |
|---|---|---|---|
| 2,686,152 | 8/1954 | Franke | 208/8 LE |
| 2,776,935 | 1/1957 | Jahnig et al. | 44/23 |
| 3,117,918 | 1/1964 | Batchelor et al. | 201/22 |
| 3,562,783 | 2/1971 | Gorin | 208/8 LE |
| 3,748,254 | 7/1973 | Gorin | 208/8 LE |
| 3,920,418 | 11/1975 | Rice | 208/8 LE |
| 4,201,655 | 5/1980 | Theodore et al. | 208/8 LE |

*Primary Examiner*—Bradley R. Garris

*Attorney, Agent, or Firm*—F. Lindsey Scott; William A. Mikesell, Jr.

[57] ABSTRACT

The present invention is an improvement in the known process of making a coking feedstock from non-caking or weakly caking coals for slot-type coke ovens wherein the coal is subjected to solvent extraction; and at least the non-distillable extract in the effluent slurry product, after removal of part or all of the solvent, is mixed with carbonaceous solids to serve as a binder therefor. The improvement resides in the use of fluidizer char (which is produced by the low temperature carbonization of coal in a fluidized bed) as the carbonaceous solids. The fluidizer char is preferably mixed with the coal extract slurry (after removal of solvent) in a liquid state at elevated temperatures under pelletizing and non-carbonizing conditions. The pelletized product, after cooling and crushing, is suitable as part or all of the coking feedstock for coke ovens.

9 Claims, 1 Drawing Figure

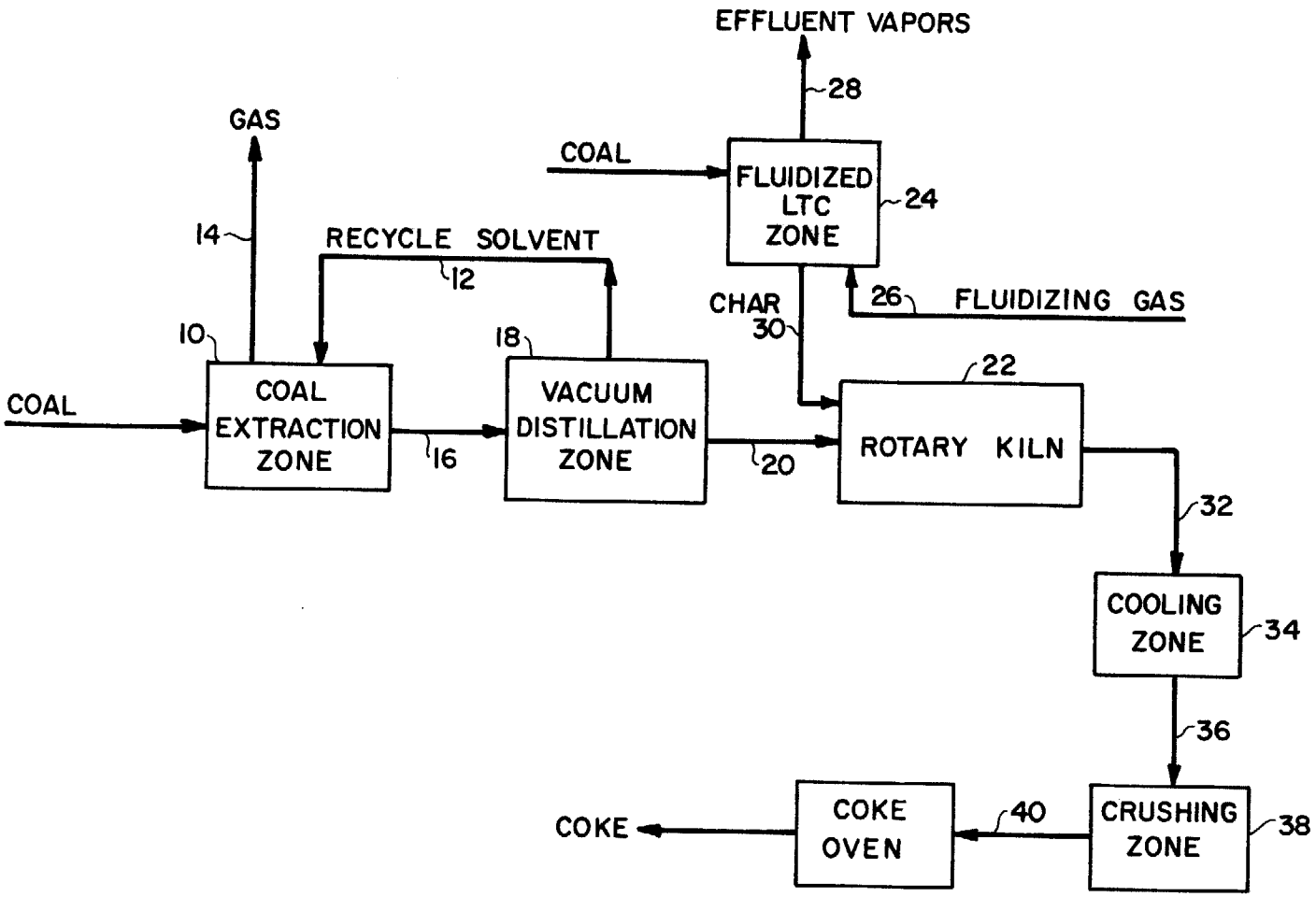
COAL
COAL EXTRACTION ZONE
10
GAS
14
RECYCLE SOLVENT
12
VACUUM DISTILLATION ZONE
18
16
20
ROTARY KILN
22
CHAR
30
FLUIDIZED LTC ZONE
24
26
FLUIDIZING GAS
COAL
EFFLUENT VAPORS
28
32
COOLING ZONE
34
36
CRUSHING ZONE
38
40
COKE OVEN
COKE

PROCESS FOR MAKING METALLURGICAL COKE USING FLUIDIZER CHAR

This application is a continuation-in-part of our earlier filed application, U.S. Ser. No. 764,629, filed Feb. 1, 1977, entitled "Feedstock for Coke Ovens," now abandoned.

This invention relates to an improvement in the synthesis of feedstocks for conventional slot-type coke ovens. More particularly, it relates to the production of synthetic coking coals from non-caking or weakly caking coals.

Processes are known for making part or all of the feedstock to a slot-type coke oven from non-caking or weakly caking coals by means of solvent extraction of such coals. The extract so produced, after substantial removal of the extraction solvent and with or without separation of the undissolved solids, may serve by itself as a synthetic coking coal, or as the binder in proper proportions for other carbonaceous solids added to the feedstock for the coke oven. Illustrative of such processes are those described in the following publications.

U.S. Pat. No. 1,563,595—Sperr—Dec. 1, 1925
U.S. Pat. No. 1,675,266—Hansard—June 26, 1928
U.S. Pat. No. 1,925,005—Rose et al.—Aug. 29, 1933
U.S. Pat. No. 1,936,882—Rose et al.—Nov. 28, 1933
U.S. Pat. No. 2,166,321—Pott—July 18, 1939
U.S. Pat. No. 2,686,152—Franke—Aug. 10, 1954
U.S. Pat. No. 3,562,783—Gorin—Feb. 9, 1971
U.S. Pat. No. 3,617,513—Wilson et al.—Nov. 2, 1971
U.S. Pat. No. 3,748,254—Gorin—July 24, 1973
"The Uhde Process"—W. Krönig.—"Katalytische Kruckhydrierung" (1950), pages 97–101.
Fiat Final Report No. 1272—PB 93328—June 1, 1949, "I.G. Rights in the Hydrogenation Field," E. Schutzrechte, by O. Gohre, pages 25, 26, 69–71).
Chemistry of Coal Utilization, Suppl. Vol.—1963, H. H. Lowry, Editor, pages 1062–1064.

The feedstocks synthesized by the processes described in the above-cited references yield products from the coke oven which have the requisite strength and hardness for use in a blast furnace. However, upon shatter of the coke oven product resulting from pushing from the oven, the size consist of the fragmented coke generally includes too large an amount of coke pieces outside the desired size range which is approximately 0.5 to 4.0 inches (about 1.3 to about 10 cm).

Accordingly, the primary object of the present invention is to provide an improvement in the aforementioned processes whereby coke which is not only of the desired strength and hardness but also of the desired size consist, is produced.

In accordance with our invention, the desired improvement is achieved by the use of "fluidizer char" (hereinafter defined) as the carbonaceous solids which are mixed with the coal extract by any suitable mixing equipment; but, preferably, by effecting such mixing in a rotary kiln at a temperature sufficiently high to maintain the extract in a liquid state and under pelletizing and non-carbonizing conditions. The pelletized product is readily handleable in subsequent cooling and crushing operations. A synthetic coking coal is thereby produced which may be fed as the sole feedstock to a coke oven, or as at least one of the coking coals contained in a conventional mix of coals used in coke oven feedstocks. Surprisingly, we have found that the product coke pushed from the coke oven consistently has a size range falling substantially within the size range prescribed for use in a blast furnace. Thus, the economy of the coke oven is improved, not only by the use of the cheaper weakly or non-caking coals, but also by the increase in the yield of desired product per pass through the coke oven.

For a better understanding of our invention and its objects and advantages, reference should be had to the accompanying drawing in which the preferred embodiment of our invention is schematically illustrated, and to the following description.

A weakly caking coal is introduced into a Coal Extraction Zone 10. The coal had the following pertinent specifications: percent (%) volatile matter (V.M.) on a dry basis-41.4; % ash-8.7; % S-3.00; Free Swelling Index (FSI) (ASTM-D720-67)-2-½; and Gieseler fluidity (DDPM-Dial Division Per Minute) (ASTM-D1812-69)-1.1.

A coal liquefaction solvent is introduced into a Coal Extraction Zone 10 thorugh a conduit 12. A suitable coal liquefaction solvent is a mixture of polycyclic aromatic hydrocarbons which is liquid under the conditions of temperature and pressure maintained during coal liquefaction. A suitable boiling range for such a solvent is within the range 230° to 475° C. The solvent may be conveniently derived as a distillate fraction from one or more of the unit operations of the present process. If so, such a solvent may contain phenols and heterocyclic compounds as well as the polycyclic hydrocarbons.

The selected coal, in a finely divided state, is subjected, in Extraction Zone 10, to solvent extraction in the presence of hydrogen available at the extraction conditions. The extraction operation may be any of those used by those skilled in the art, for example, continuous, batch, counter-current or staged extraction. Hydrogen is preferably supplied as gaseous hydrogen. However, it may be supplied by means of a hydrogen-donor solvent. If gaseous hydrogen is used, the solvent may be any suitable polycyclic aromatic hydrocarbon, or mixtures of polycyclic aromatic hydrocarbons which are liquid at the temperature and pressure of extraction, and derived from the process itself as previously mentioned. If a hydrogen-donor solvent is used, at least a portion of the polycyclic aromatic hydrocarbons is partially hydrogenated. Such a solvent may be rehydrogenated to restore its effectiveness as a hydrogen donor for recycle.

The conditions maintained in Extraction Zone 10 are typically as follows:

Temperature, °C.: 400–450
Pressure, Kg/cm$^2$: 30–200
$H_2$ consumed, Wt.% MAF* coal: 0.70–2.5
Solvent-to-coal wt. ratio: 1.5–3.0

*MAF means moisture- and ash-free coal.

The products produced in Extraction Zone 10 consist of effluent vapors and gases which are discharged through a conduit 14 and an effluent slurry which is removed through a conduit 16. The effluent slurry contains extract (which is substantially non-distillable under non-coking conditions), undissolved solids and solvent. The relative proportions of extract and undissolved solids are determined by the conditions maintained in the Extraction Zone 10. Under the above typical conditions, conversions of the MAF coal may be as high as 95 percent. In this preferred embodiment, no separation of extract and undissolved solids is effected. However, if desired, partial or complete removal of the solids by known methods may be effected. The entire effluent slurry is conducted by conduit 16 to a Vacuum Distillation Zone 18 where substantially all the distillables are removed under non-coking conditions. These distillables preferably are then fractionally distilled (not shown) to recover the desired solvent fraction which is recycled through conduit 12 to the Coal Extraction Zone 10. Make-up solvent may be suitably added as required. The vacuum bottoms, consisting essentially of extract and undissolved solids, with preferably enough residual solvent, if required, to render the mixture pumpable, is transferred through a conduit 20, without deliberate cooling, to a Rotary Kiln 22 wherein the vacuum bottoms serves as binder for "fluidizer char," in accordance with the present invention.

The "fluidizer char" is produced in a Fluidized Low Temperature Carbonization (LTC) Zone 24. Coal (of any rank, caking or non-caking) in finely divided form is introduced into the LTC Zone 24. This Zone is maintained under fluidizing conditions in any well-known manner at a temperature in the range 400° to 600° C., preferably about 500° C., to effect conversion of the coal to char and vaporous products.

A fluidized bed of char and added coal is maintained in the LTC Zone by means of a fluidizing gas introduced through a conduit 26, in a manner now well known. The fluidizing gas may be preheated inert gas, steam or gas which contains oxygen (air, if desired). If the latter, the heat required to effect carbonization is supplied by the partial oxidation of coal or char in the fluidized bed, again in the well-known manner. Otherwise, the requisite heat must be supplied by preheat of the coal and fluidizing gas, or by other suitable means. Vaporous products of the LTC Zone are discharged as effluent vapors through a conduit 28. These may be fractionated to recover tar and light oil fractions and non-condensible gases that can serve as fluidizing gas. The particulate char has a bulk density of about 20–50 pounds per cubic foot and a particle size distribution such that virtually all will pass through an 8-mesh Tyler Standard screen. Generally, the char has a volatile matter content of about 5 to 20 weight percent. It is this char which is herein referred to as "fluidizer char" and which is essential to the improvement provided by our invention. The "fluidizer char," while still hot, is conducted through a conduit 30 to the Rotary Kiln 22, which is a substantially horizontal, but slightly inclined, cylindrical rotary kiln.

The primary function of the Rotary Kiln is to blend, by its rotating tumbling action, the fluidizer char and the vacuum bottoms while forming pellets below the carbonization temperature of the vacuum bottoms. It is important to regulate the relative amounts of fluidizer char and the vacuum bottoms so as to form a mixture which is pelletizable. In general, the total solids, including both fluidizer char and solids in the vacuum bottoms, constitute between 50 and 75 weight percent of the mixture. It is also important that the extract itself be in a liquid state at some point in its traverse through the Kiln. Further, premature carbonization of the mixture must be avoided. Temperatures are therefore maintained in the Rotary Kiln which satisfy these requirements, preferably between 260° and 320° C. The requisite heat is provided adiabatically, that is, by the heat contained in the two input streams. Adjustment of temperature to meet the foregoing requirements may be effected by controlled preheat or cooling, as the case may be, of one or both of the two input streams. The size of the pellets produced in the Rotary Kiln is generally between 14-mesh Tyler Standard screen and five centimeters.

The hot pellets are conducted from the Rotary Kiln through a conduit 32 to a Cooling Zone 34 where the pellets are cooled to a temperature suitable for crushing. The cooled pellets are then conducted through a conduit 36 to a Crushing Zone 38 where the pellets are crushed to a size range of about 1 cm×0. The crushed product is transferred through a conduit 40 to a Coke Oven to serve as part or all of the feed to the Coke Oven. The FIGURE shows the use of the crushed product as all of the Coke Oven feed. In the event that the crushed product comprises a part of the feed to the Coke Oven, other materials such as coal or the like may be mixed with the crushed product in line 40, or the like to produce a mixture to serve as the feed to the Coke Oven. The Coke oven is of the conventional slot type and is operated in conventional manner.

Surprisingly, when the crushed product is used as part or all of the feed to the coke oven, a coke product is obtained upon coking which is substantially of the size range preferred for use in a blast furnace. The economy of the coke oven is improved, not only by the use of cheaper weakly or non-caking coals, but also by the increase in the yield of desired product per pass through the coke oven. A suitable size range for blast furnace coke is from about 0.5 to about 4.0 inches (about 1.3 to about 10 cm). Some users prefer a size range from about 0.75 to about 4.0 inches (about 2.0 to about 10 cm) while other users prefer a size range from about 0.5 to about 3.0 inches (about 1.3 to about 7.5 cm). The choice of a preferred range may be rather arbitrary but since the size ranges preferred by coke users are as stated, it is clearly desirable to produce coke in such size ranges. Of the two ranges, probably the size range from about 0.5 to about 3.0 inches (about 1.3 to about 7.5 cm) is more widely preferred. The coke so produced also has the other desirable properties usually required for blast furnace coke.

The coke produced by coking blends of carbonaceous binder and fluidizer char as described above results in the production of coke upon shattering which is predominantly of the desired size. Typically more than 50 percent of the product coke is of the desired size. In many instances, yields of the desired size range in excess of 75 percent have been obtained an in some instances, yields as high as 90 percent have been obtained. The foregoing percentages are by weight and are based on the total coke product yield.

Having thus described the invention by reference to its preferred embodiments, it is pointed out that the embodiments described are illustrative rather than limiting in nature and that many variations and modifications are possible within the scope of the present invention. Such variations and modifications may appear obvious and desirable to those skilled in the art based upon a review of the foregoing description of preferred embodiments and the following examples.

Experimental

The four runs reported below in Table II are runs selected to demonstrate the different effects obtained from different chars when used under otherwise identical conditions. In Run No. 1, fluidizer char (Char A) was used which was made from caking coal. In Run No. 1*a*, fluidizer char (Char B) was used which was made from a non-caking coal. In Run No. 2, a char (Char C)

was used which was made by low temperature carbonization in a rotary drum, i.e. under non-fluidized conditions, and subsequently heated to 620° C. In Run No. 3, the char (Char D) was coke breeze, i.e. the finely divided undersize product from a conventional slot-type oven.

The weakly caking coal used in the solvent extraction step of all four runs had the following analysis on a weight percent moisture-free basis: volatile matter—39.3%; ash—8.7% sulfur—0.88%; and the following properties: Gieseler Fluidity, DDPM (Dial Division Per Minute) (ASTM-D1812-69)—1.1; and Free Swelling Index (FSI) (ASTM-D720-67)-2-½.

The coal was extracted with a distillable polycyclic hydrocarbon (derived from the process itself) in the presence of $H_2$ gas at 1700 psig. pressure at about 440° C., with a solvent-to-coal ratio of 3 to 1, and a residence time of 45 minutes. The depth of extraction was about 90–95 weight percent on a MAF basis. The solvent-free slurry was prepared by vacuum distillation in a batch still at about 300° C. at 1 mm Hg pressure.

The effluent slurry product on a solvent-free basis has the following analysis:

| | |
|---|---|
| Proximate Analysis, Wt. % MF (moisture-free) | |
| Volatile Matter | 49.60 |
| Ash | 13.07 |
| Ultimate Analysis, Wt. % MF | |
| Hydrogen | 4.74 |
| Carbon | 74.69 |
| Nitrogen | 1.73 |
| Sulfur | 1.58 |
| Distillate | |
| Wt. % - 240° C. at 1 mm Hg | 6.9 |
| Wt. % - 290° C. at 1 mm Hg | — |
| Conradson Carbon | 68.4 |

The chars, Char A, Char B, Char C and Char D, previously identified, had the analyses tabulated below:

TABLE I

ANALYSIS OF CHARS

| Char | Char A (Fluidizer Chars) | Char B (Fluidizer Chars) | Char C (Non-fluidized Char) | Char D (Coke Breeze) |
|---|---|---|---|---|
| Proximate Analysis, Wt. % MF | | | | |
| Volatile Matter | 20.29 | 22.09 | 8.40 | 3.37 |
| Ash | 10.23 | 13.25 | 18.33 | 16.44 |
| Ultimate Analysis, Wt. % MF | | | | |
| Hydrogen | 2.84 | — | 1.84 | — |
| Carbon | 71.42 | — | 75.03 | — |
| Nitrogen | 1.44 | — | 1.46 | — |
| Sulfur | 1.28 | 0.78 | 0.94 | 0.95 |
| Screen Analysis, Wt. % Mesh | | | | |
| +8 | 3.7 | 10.6 | 3.1 | 0 |
| 8 × 14 | 3.7 | 46.5 | 6.6 | 38.1 |
| 14 × 28 | 15.5 | 33.2 | 21.4 | 40.5 |
| 28 × 48 | 29.5 | 6.3 | 20.3 | 11.6 |
| 48 × 100 | 24.7 | 2.8 | 17.7 | 5.0 |
| 100 × 200 | 15.3 | 0.5 | 13.5 | 2.0 |
| 200 × 325 | 6.1 | 0.1 | 7.6 | 1.0 |
| −325 | 1.5 | 0.0 | 9.8 | 1.4 |
| Bulk Density, lb/ft³ | 26 | 49 | 52 | 39 |

In Table II below are reported the results obtained by coking blends of the solvent-free slurry product with each of the four Chars A, B, C and D, in a coke oven. Each of the blends was prepared in a five-foot diameter batch rotary kiln. In these runs, the feed materials, i.e. vacuum bottoms and char, were charged to the kiln at ambient conditions in the proportions indicated. The kiln was purged with nitrogen to expel air and then heated externally to a bed temperature of about 300° C. During the entire heating procedure, the kiln was rotated at 12 rpm. The kiln was then cooled down to ambient conditions and all the contents removed. The cooled solid product was ground to a size range of 1 cm×0 before being charged to the coke oven.

TABLE II

| Run No. | 1 | 1a | 2 | 3 |
|---|---|---|---|---|
| Oven[1] Charge, Wt. % | | | | |
| Char A (Fluidizer Char) | 48 | | | |
| Char B (Fluidizer Char) | | 60 | | |
| Char C (Non-fluidized char) | | | 67 | |
| Char D (Coke Breeze) | | | | 55 |
| Vacuum Bottoms | 52 | 40 | 33 | 45 |
| Charge Conditions to Oven | | | | |
| Wt. % Moisture | 6.4 | 6.5 | 6.4 | 5.4 |
| Wt. % Volatile Matter (dry basis) | 31.7 | 31.5 | 18.4 | 20.6 |
| Wt. % Ash (dry basis) | 13.7 | 13.2 | 15.2 | 15.2 |
| Wt. % Sulfur (dry basis) | 1.26 | 1.45 | 1.09 | 1.23 |
| Bulk Density, lb/ft³ (dry basis) | 47.4 | 48.4 | 48.5 | 49.0 |
| Conradson Carbon | 76.5 | — | 90.5 | — |
| Gieseler Fluidity | | >28,000 | | |
| Coke Quality | | | | |
| Coke Stability,[2] +1" | 54.3 | 54.3 | 45.6 | 21.5 |
| Coke Hardness,[2] +¼" | 73.8 | 70.8 | 51.4 | 23.8 |
| Average Size,[3] inches | 1.8 | 1.8 | 3.6 | 6.5 |
| Yield of ½ × 3" coke | 87.4 | 90.8 | 34.1 | 9.6 |
| Coke Yield, wt. % | 72.6 | 71.5 | 85.3 | 63.5 |
| Coke Yield, ½ × 4" | 94.0 | 94.9 | 49.7 | 14.6 |
| Coking Conditions | | | | |
| Flue Temperature, °F. | | 2300 | | |
| Coking Time, hrs:min. | 18:28 | 19:30 | 18:08 | 18:10 |
| Coke, Center Temp., °F. | 1830 | 1700 | 1760 | 1820 |
| Peak Wall Pressure, psi | 0 | 0 | 0 | 0 |

[1]The coke oven employed for this study was an experimental 18-inch movable-wall oven of a standard design used by many steel companies for evaluation of coking properties of coals. Approximately 700 pounds of feedstock can be charged to the oven which has inside dimensions of 36" × 36" ×18". Heat to the oven is supplied from the two oven walls which are maintained at 2300° F. After a normal coking run, the coked charge is pushed from the oven when the center of the charge, the coldest spot, reaches 1800° F. The time required for coking is usually about 18 hours. During the run, the pressure exerted by the charge on the oven walls can be measured.

[2]A.S.T.M. Standard Procedure D-294-64(1972).

[3]A.S.T.M. Standard Procedure D-3038-72.

A comparison of the yield of the 0.5×3.0 inch coke produced in each of the tests illustrates clearly that a very high percentage of the total product coke is of the desired size (0.5 to 4.0 inches) when fluidizer char is used and that the percentage of the total product coke in the desired coke range is much less when non-fluidized char or coke breeze is used.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

We claim:

1. In a process of making coke from a non-caking or weakly caking coal wherein a mixture in proper proportions of carbonaceous solids and carbonaceous binder derived from said coal by solvent extraction thereof is used as part or all of the feed to a coke oven, the improvement which comprises the use of fluidizer char produced by the low temperature carbonization of coal in a fluidized bed as said carbonaceous solids, thereby producing a coke product upon shattering which is predominantly in the size range from about 0.5 to about 4.0 inches.

2. The improvement of claim 1 wherein said size range is from about 0.5 to about 3.0 inches.

3. The improvement of claim 1 wherein said size range is from about 0.75 to about 4.0 inches.

4. The improvement of claim 1 wherein at least 50 weight percent of the coke so produced is in said size range.

5. In the process of making blast furnace coke from a non-caking or weakly caking coal wherein a mixture in proper proportions of carbonaceous solids and carbonaceous binder derived from said coal by solvent extraction thereof is used as part or all of the feed to a coke oven, the improvement which comprises blending said carbonaceous binder with carbonaceous solids comprising char produced by the low temperature carbonization of coal in a fluidized bed, said blending being effected by tumbling said binder in a liquid state and said char in a rotary kiln under pelletizing and non-carbonizing conditions, whereby a coke product which is predominantly in the size range from about 0.5 to about 4.0 inches is produced upon shattering.

6. The improvement of claim 5 wherein said size range is from about 0.5 to about 3.0 inches.

7. The improvement of claim 5 wherein said size range is from about 0.75 to about 4.0 inches.

8. The improvement of claim 5 wherein at least 50 weight percent of the coke so produced is of a size from about 0.5 to about 4.0 inches.

9. The process of producing a strong, lump coke from a non-caking or weakly caking coal comrpising:

(a) extracting said coal with a solvent in the presence of hydrogen available at extraction conditions, to yield a product containing extract and solid hydrocarbonaceous residue;

(b) removing at least the majority of the solvent from said product;

(c) thereafter blending said extraction product in a liquid state with finely divided fluidizer char at elevated temperature under non-carbonizing conditions;

(d) recovering the product from step (c), cooling and crushing same to a finely divided state;

(e) subjecting said product from step (d) to destructive distillation in a conventional slot-type coke oven; and (f) recovering coke from said coke oven which after shattering has a size range predominantly from about 0.5 to about 4.0 inches.

* * * * *